United States Patent [19]

Alten

[11] 4,007,343

[45] Feb. 8, 1977

[54] METHOD AND APPARATUS FOR SENSING FLUID PRESSURE

[75] Inventor: Ralph W. Alten, East Detroit, Mich.

[73] Assignee: Dynamic Industries, Inc., Warren, Mich.

[22] Filed: Jan. 5, 1976

[21] Appl. No.: 647,258

[52] U.S. Cl. ..... 200/83 J; 200/DIG. 79

[51] Int. Cl.[2] ..... H01H 35/34

[58] Field of Search ..... 73/398 R, 398 AR, 406; 338/42, 41; 200/83 R, 83 J, 83 A, 83 WM, 83 V

[56] References Cited

UNITED STATES PATENTS

| | | | |
|---|---|---|---|
| 1,932,428 | 10/1933 | Swezey | 200/83 R |
| 2,744,977 | 5/1956 | Lombard et al. | 200/83 J |

*Primary Examiner*—Donald O. Woodiel
*Attorney, Agent, or Firm*—Cullen, Settle, Sloman & Cantor

[57] ABSTRACT

A method and apparatus is disclosed for visually indicating when the pressure of a fluid, such as oil in an automobile, falls below a predetermined value. The improvement resides in a novel pressure switch which is typically connected in series in an electrical circuit with a power source and a visual indicator, such as a so-called "idiot light" in an automotive instrument panel. The pressure switch includes a housing with an internal recess and a fluid passageway extending from the internal recess for communication with a fluid under pressure. A resilient, flexible, elastomeric diaphragm overlies the passageway within the recess and is deflected in response to the fluid pressure. An annular, electrically conductive, stationary contact element is positioned adjacent to the diaphragm; and a spherical, electrically conductive contact element is biased by a coil spring toward the opening in the annular contact element and into engagement with the diaphragm. When the fluid pressure is below a certain predetermined value, the two contact elements are biased into engagement to close the circuit and provide an appropriate visual indication. When the fluid pressure is in excess of the predetermined value, deflection of the diaphragm displaces the spherical contact element and breaks the circuit.

1 Claim, 3 Drawing Figures

METHOD AND APPARATUS FOR SENSING FLUID PRESSURE

BACKGROUND OF THE INVENTION

1. Field of the Invention

The present disclosure relates generally to a novel pressure switch and its method of operation in an electrical circuit for indicating whether the pressure of a fluid is either above or below a preselected value.

2. The Prior Art

Numerous types of sensors, switches and gauges have been developed and used in the prior art for indicating the pressure of a fluid. For a specific example, two totally different types of switches have been used in the automotive industry to visually display oil pressure in an automobile instrument panel.

One of those types of switches typically includes a variable resistor designed to provide a variable readout by way of a gauge. Due in part to the expense of this first type of switch, the industry has turned predominantly to a second type of switch, the so-called "idiot light" that is illuminated when the oil pressure falls below a predetermined critical value. The prior art switch for this arrangement is somewhat simple in design, but is not without inherent disadvantages.

More specifically, the prior art switches for the idiot light arrangement are designed for an on-off operation and include one fixed and one movable contact element, the movable contact element having somewhat of a flattened T-shaped cross section. This particular cross sectional configuration is disadvantageous for several reasons. For example, this element is more costly than the corresponding component proposed by the present invention. Further, the configuration of this element requires an unnecessary enlargement of the additional ancillary components of the pressure switch, thereby unnecessarily increasing the cost of the prior art devices.

SUMMARY OF THE INVENTION

The present invention overcomes the prior art problems by providing a pressure switch which includes a housing with a cavity and a passageway extending from the cavity to the exterior of the housing to receive oil under pressure, such as from the engine block of an automotive vehicle. A flexible, resilient diaphragm is positioned in the cavity to overlie the passageway, the diaphragm being deflectible in response to fluid pressure within the passageway. A biasing means, such as a compressive coil spring, is positioned within the cavity in substantial alignment with the passageway. Further, a pair of relatively movable, electrically conductive contact elements are interposed between the biasing means and the diaphragm, one of the contact elements comprising a stationary member adjacent the diaphragm and having a circular opening therethrough. The other of the contact elements consists of a movable, spherical member interposed between the stationary contact member and the biasing means, with the spherical member having a diameter at least slightly larger than the diameter of the opening in the stationary contact member. This arrangement enables selective, essentially only annular line contact between the contact elements when the fluid pressure is below a predetermined value. At greater fluid pressures, the diaphragm is deflected to urge the spherical contact element away from the stationary contact element against the resistive force of the biasing means to break the electrical circuit and thereby de-activate the indicator means.

One method of operation proposed by the invention includes interconnecting a pressure switch (a) in communication with a fluid under pressure and (b) in series in an electrical circuit that includes a power source and a visual pressure indicator. The pressure switch includes a movable, electrically conductive, spherical contact element that is normally biased into annular line contact with a second electrically conductive contact element when the pressure of the fluid is below a predetermined value. Under these circumstances, the electrical circuit is closed and the visual pressure indicator is illuminated.

Next, the method includes displacing the spherical contact element away from the second contact element by a resilient diaphragm when the pressure of the fluid is above the predetermined value. This breaks the circuit to discontinue illumination of the visual pressure indicator.

Thus, the method and apparatus of the present invention provide the following advantages over the prior art: (1) An elimination of parts to cut down on assembly time and to provide increased reliability; (2) a reduction in size of the component parts to lower the cost; and (3) a reduction in the size of the compressive coil spring due to a reduction in force on the component parts from the fluid pressure because the component parts have a reduced cross sectional area.

These and other meritorious features of the present invention will be more fully appreciated from the following detailed description and the appended claims.

DETAILED DESCRIPTION OF THE PREFERRED EMBODIMENT

Figure 1:
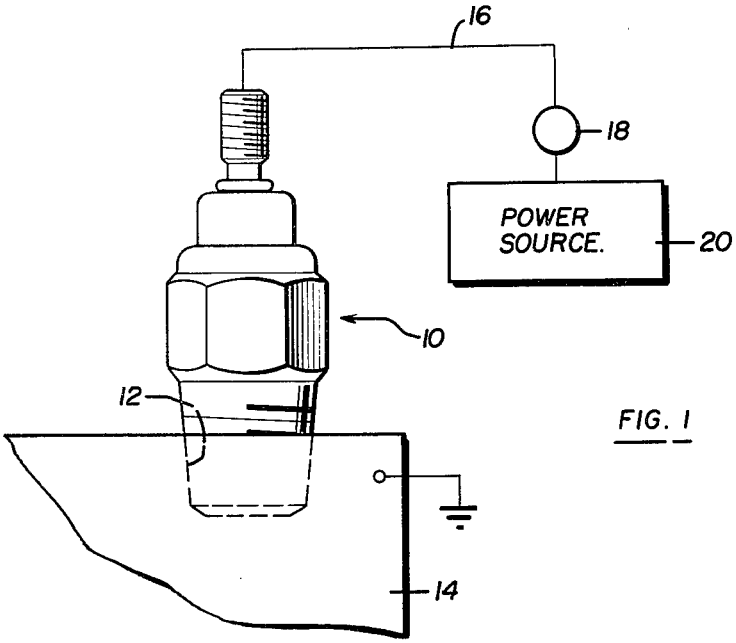
FIG. 1 is a schematic illustration of the pressure switch of the present invention, connected to an engine block and in series with an electrical power source.

Referring now to the drawings, reference numeral 10 indicates a pressure switch which is threadedly received within a receptacle 12 of an engine block 14. The receptacle 12 communicates with fluid, such as oil, under pressure and the pressure switch 10 responds to the fluid pressure to provide a suitable electrical response, as more fully disclosed below.

Additionally, FIG. 1 illustrates the pressure switch electrically connected in series by way of an electrical line 16 with a pressure indicator 18 and a power source 20. The pressure indicator 18 may be of any common construction, such as a visual or audible indicator, but in the most preferred embodiment this element is a so-called "idiot light" found commonly in automotive instrument panels. The power source 20 may likewise be any suitable source; however, in the most preferred embodiment, this source is a 12-volt DC battery which provides power to an automotive instrument panel.

FIG. 1 further indicates that the engine block 14 serves as an electrical ground for the circuit defined by the power source 20, the indicator 18, electrical line 16, and the pressure switch 10.

In operation, the internal components of the pressure switch are displaced in response to fluid pressure to either (a) open the electrical circuit when the fluid pressure is above a preselected value so that the indicator is not activated or (b) close the circuit when the fluid pressure is below the preselected value in order to activate the indicator to provide an appropriate signal.

Figure 2:
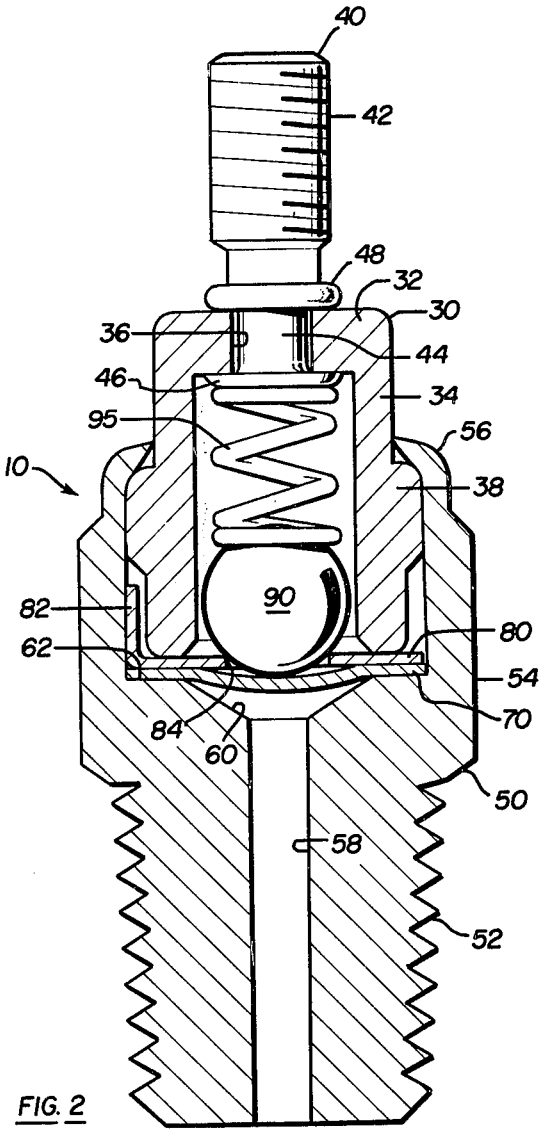
FIG. 2 is a partial cross sectional illustration of the pressure switch under low fluid pressure conditions, whereby the spherical contact element is biased into annular line contact with the stationary annular contact element.

Referring now to FIG. 2, the pressure switch is illustrated in detail, depicting a low fluid pressure condition when the electrical circuit is closed and the indicator 18 is activated.

As shown in FIG. 2, the pressure switch includes a pair of housing members 30 and 50 suitably secured together to collectively define an enclosed recess or cavity to receive the internal components of the switch mechanism.

Housing 30 is essentially cup-shaped in cross section and is formed most preferably of a glass-filled polyester material. This member includes a base 32 and an essentially tubular sidewall portion 34. A circular opening 36 is provided in the base and the sidewall 34 includes an annular rib or bead 38 for a purpose explained below.

An electrical terminal 40 is positioned within the opening 36 to provide an electrical connection to line 16 and also to provide electrical contact with the internal component of the pressure switch. Thus, the terminal 40 includes a threaded end portion 42, a shank 44 extending through the opening 36, and an end portion 46 within the recess of the pressure switch, the end portion 46 being formed, for example, by a riveting-type operation. Additionally the terminal includes an annular bead 48 abutting against the outer end portion of base 32 to maintain the terminal in proper position.

According to the present disclosure, housing member 50 is formed of an electrically conductive material, and in the most preferred embodiment is comprised of steel that has been zinc plated. This member includes a threaded, essentially cylindrical base 52 and a hexagonal collar 54 terminating in an essentially annular lip 56 that is curled inwardly over annular bead 38 to secure the two housing members 30 and 50 together, as illustrated.

A circular bore 58 extends the length of base 52 and terminates in an outwardly flared, tapered region 60, thus defining an annular support surface 62 in the housing recess.

A circular, flexible diaphragm 70 is positioned within the housing recess to overlie the tapered region 60 and the bore 58. As illustrated, an outer annular portion of the diaphragm is positioned against the annular support surface 62 of the housing member 50. The diaphragm may consist of a Mylar film (a trademark of the Dupont Corporation for a film of polyethylene terephthalate material), but such a material would most likely require a gasket. A more preferred material is elastomeric and resilient, these characteristics being found in certain film stocks sold under the trade name Fairprene, a registered trademark of the Dupont Corporation.

A stationary contact element or ground strap 80 is also positioned within the housing recess in interposed relationship between the diaphragm 70 and the terminal annular portion of housing member 30. In the most preferred embodiment, the ground strap 80 is essentially annular to fit within the circular housing recess. The outer configuration, however, of the ground strap is not critical. The important feature is the provision of a circular opening 84. Additionally, the ground strap 80 includes a tab segment 82 for contacting the electrically conductive housing member 50. In the most preferred embodiment, the ground strap is comprised of either copper or copper-coated steel.

The only other internal components required by the present invention includes a movable, spherical, electrically conductive contact element 90 and an electrically conductive compression spring 95. In the most preferred embodiment, the spherical ball 90 is copper plated steel and the spring member 95 is either spring steel or copper.

As illustrated, the spherical ball 90 has a diameter that is at least slightly greater than the diameter of the circular opening 84 in the stationary contact element 80. As a result, substantially only annular line contact is established between the two contact elements 80 and 90 when positioned as illustrated in FIG. 2.

In operation, fluid under pressure is received within bore 58 and tapered region 60 to exert pressure against the flexible diaphragm 70. When the pressure of the fluid is below a predetermined value, the spherical contact element will be positioned as shown in FIG. 2 to establish electrical communication with the stationary contact element 80. If the engine is on and the power source is activated, contact between the elements 80 and 90 closes the electrical circuit and activates indicator 28, it being understood that the electrical flow through the pressure switch 10 is by way of: terminal 40, spring 95, spherical contact 90, annular contact 80, and housing 50.

Figure 3:
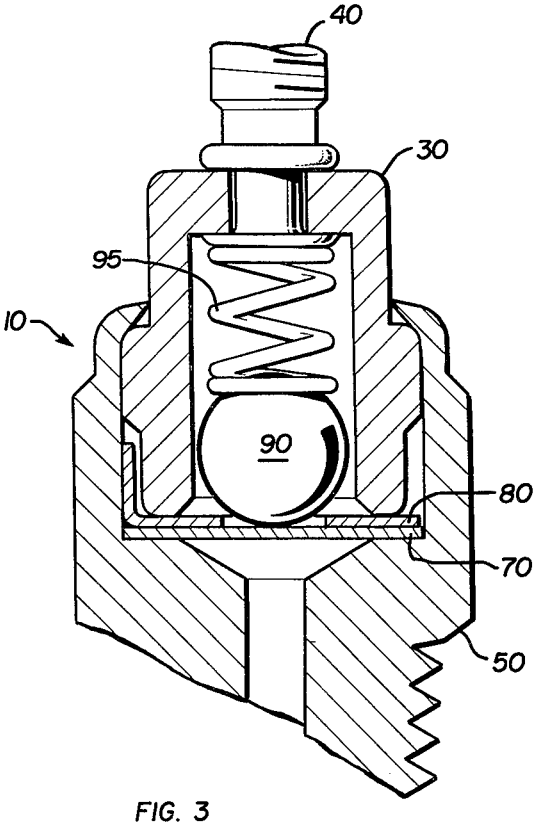
FIG. 3 is a partial cross sectional view similar to that of FIG. 2, but with the spherical contact element illustrated as spaced from the fixed contact element due to deflection of the diaphragm in response to fluid pressure.

As illustrated in FIGS. 2 and 3, the spherical contact element 90 is continuously in engagement with both the flexible diaphragm 70 and the compression spring 95. When the pressure of the fluid is above the predetermined value, the diaphragm is displaced to the position illustrated in FIG. 3 to displace the spherical contact element away from the circular contact edge on the stationary contact 80 against the biasing force of compression spring 95. As will be appreciated, the biasing force of the spring determines the preselected pressure at which the spherical contact element is displaced away from the stationary annular contact element 80. As illustrated in FIG. 3, the electrical circuit is broken and the indicator 18 is not activated, thus providing the appropriate output signal. For example, in an automobile the indicator 18 is a common "idiot light" which is not illuminated within a desired range of oil pressure but which becomes illuminated when the oil pressure drops below a preselected value.

It is to be understood that the disclosed embodiment is exemplary of the present invention and is not to be intended as limiting in manner, the invention being defined by the appended claims.

Having therefore completely and fully described and disclosed my invention, I now claim:

1. A pressure switch for use in an electrical circuit for monitoring fluid pressure, comprising:

a housing comprised of first and second attached members defining an enclosed recess, the first member being comprised of steel, being electrically conductive and having (a) a threaded, essentially cylindrical base for connection to a fluid pressure source, (b) an essentially annular collar concentric with and extending away from the base, and (c) a bore extending through the length of the base to receive fluid under pressure, the bore terminating adjacent the collar in an outwardly flared tapered region to form an annular support surface on one end of the cylindrical base in the housing recess, said first member forming a part of the electrical circuit when the pressure switch is connected to a power source;

the second member being comprised of polyester resin and being unitary, essentially cup-shaped, and being electrically non-conductive, and including (a) an essentially tubular portion received within the annular collar of the first member and terminating in an annular end surface and (b) a base at the distal end of the tubular portion with respect to the base of the first member, the base of the second member having an opening therein and receiving an electrical terminal element for connection to an electrical power source for monitoring fluid pressure;

an elastomeric, flexible diaphragm within the housing recess, interposed between the annular end surface of the second member and the annular support surface on the base of the first member to overly said bore and said tapered region, the flexible diaphragm being responsive to pressure exerted thereagainst by fluid received in said bore;

an essentially annular electrical contact element interposed between and in abutting contact with both the flexible diaphragm and the annular end surface of the second member, said annular contact element including a tab member in engagement with the first housing member to establish electrical communication therebetween;

an electrically conductive coil spring within the housing recess and being in contact with said electrical terminal element; and an axially movable, spherical, electrically conductive metal ball interposed between and in engagement with both said coil spring and the flexible diaphragm, said metal ball being concentrically aligned with the annular contact element and having a diameter at least slightly greater than the diameter of the opening in the annular contact element to selectively establish essentially only annular line contact therebetween, the metal ball having a diameter substantially the same as but slightly less than the inner diameter of the tubular portion of the second housing member and the compression spring maintaining the metal ball in engagement with the annular contact element during low fluid pressure to establish a closed electrical circuit through the pressure switch, and the flexible diaphragm displacing the metal ball toward the base of the second housing member during relatively high fluid pressure to discontinue electrical communication between the metal ball and the annular contact element.

* * * * *